US006458755B2

(12) United States Patent
Schnepp-Hentrich et al.

(10) Patent No.: US 6,458,755 B2
(45) **Date of Patent: *Oct. 1, 2002**

(54) AMORPHOUS ALKALI METAL SILICATE COMPOUND

(75) Inventors: Kathrin Schnepp-Hentrich; Rene-Andres Artiga Gonzalez, both of Duesseldorf; Katrin Burmeister, Poing; Hubert Freese, Duesseldorf; Manfred Greger, Schifflange; Bernd Larson, Erkelenz; Volker Bauer, Duesseldorf; Peter Sandkuehler, Erkelenz; Wilfried Raehse, Duesseldorf, all of (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/734,052

(22) Filed: Dec. 11, 2000

Related U.S. Application Data

(63) Continuation of application No. 08/875,232, filed as application No. PCT/EP96/00063 on Jan. 9, 1996, now Pat. No. 6,191,096.

(30) Foreign Application Priority Data

Jan. 18, 1995 (DE) ..... 195 01 269

(51) Int. Cl.[7] ..... C11D 3/08; C11D 11/02

(52) U.S. Cl. ..... 510/443; 510/509; 510/511; 510/444; 510/451; 510/452; 510/466

(58) Field of Search ..... 510/509, 511, 510/443, 444, 452, 451, 466

(56) References Cited

U.S. PATENT DOCUMENTS

| | | | | |
|---|---|---|---|---|
| 3,234,258 A | | 2/1966 | Morris | 260/460 |
| 3,838,193 A | | 9/1974 | Kajitani et al. | 423/351 |
| 3,879,527 A | | 4/1975 | Bertorelli et al. | 423/332 |
| 3,912,649 A | | 10/1975 | Berotelli et al. | 252/135 |
| 3,956,467 A | | 5/1976 | Bertorelli | 423/332 |
| 4,006,110 A | | 2/1977 | Kenney et al. | 252/540 |
| 4,122,044 A | * | 10/1978 | Nakamura et al. | 252/532 |
| 4,129,526 A | | 12/1978 | Ogoshi et al. | 252/536 |
| 4,664,839 A | | 5/1987 | Rieck | 252/175 |
| 4,816,553 A | | 3/1989 | Baur et al. | 528/245 |
| 4,820,439 A | | 4/1989 | Rieck | 252/135 |
| 5,075,041 A | | 12/1991 | Lutz | 252/548 |
| 5,318,733 A | | 6/1994 | Carduck et al. | 264/15 |
| 5,382,377 A | | 1/1995 | Raehse et al. | 252/174 |
| 5,494,488 A | | 2/1996 | Arnoldi et al. | 8/137 |
| 5,501,814 A | | 3/1996 | Engelskirchen et al. | 252/174.17 |
| 5,541,316 A | | 7/1996 | Engelskirchen et al. | 510/471 |
| 5,580,941 A | | 12/1996 | Krause et al. | 527/300 |
| 5,780,420 A | | 7/1998 | Breuer et al. | 510/466 |
| 5,798,328 A | | 8/1998 | Kottwitz et al. | 510/438 |
| 5,807,529 A | | 9/1998 | Kruse et al. | 423/332 |
| 5,814,597 A | | 9/1998 | Raehse et al. | 510/511 |
| 6,034,050 A | * | 3/2000 | Artiga Gonzalez et al. | 510/451 |
| 6,191,096 B1 | * | 2/2001 | Schnepp-Hentrich et al. | 510/443 |

FOREIGN PATENT DOCUMENTS

| | | |
|---|---|---|
| DE | 27 22 698 | 12/1977 |
| DE | 27 30 951 | 1/1978 |
| DE | 42 03 031 | 8/1993 |
| DE | 42 21 381 | 2/1994 |
| DE | 43 00 772 | 7/1994 |
| DE | 43 03 320 | 8/1994 |
| DE | 44 06 592 | 9/1995 |
| DE | 44 17 734 | 11/1995 |
| DE | 44 19 745 | 12/1996 |
| EP | 0 164 514 | 12/1985 |
| EP | 0 219 314 | 4/1987 |
| EP | 0 280 223 | 8/1988 |
| EP | 0 486 592 | 5/1992 |
| EP | 0 488 868 | 6/1992 |
| EP | 0 525 239 | 2/1993 |
| EP | 0 526 978 | 2/1993 |
| EP | 0 542 131 | 5/1993 |
| EP | 0 561 656 | 9/1993 |
| EP | 0 651 050 | 5/1995 |
| JP | 58/217598 | 12/1983 |
| WO | WO90/13533 | 11/1990 |
| WO | WO91/02047 | 2/1991 |
| WO | WO93/02176 | 2/1993 |
| WO | WO93/08251 | 4/1993 |
| WO | WO93/16110 | 8/1993 |
| WO | WO93/23514 | 11/1993 |
| WO | WO94/09111 | 4/1994 |

OTHER PUBLICATIONS

Ullmanns Enzyclopädie der technischen Chemie, 4(21):412 (1982) Not translated No month given.

* cited by examiner

*Primary Examiner*—Yogendra N. Gupta
*Assistant Examiner*—Brian P. Mruk
(74) *Attorney, Agent, or Firm*—Stephen D. Harper; Glenn E. J. Murphy

(57) ABSTRACT

A spray-dried amorphous alkali metal silicate compound which provides multiple-cycle washing performance. The silicate compound has a molar ratio of $M_2O$ to $SiO_2$ of 1:1.5 to 1:3.3 wherein M represents an alkali metal. The compound contains 0.5 to less than 30% by weight of anionic surfactant and has an absorption capacity for liquid components which is at least 20% higher than that of the same quantity of the alkali metal silicate compound which is free from anionic surfactant.

7 Claims, No Drawings

AMORPHOUS ALKALI METAL SILICATE COMPOUND

This application is a continuation of application Ser. No. 08/875,232, filed Aug. 18, 1997 U.S. Pat. No. 6,191,096, which is a 371 of application Ser. No. PCT/EP96/00063, filed Jan. 9, 1996.

This invention relates to an amorphous alkali metal silicate compound with multiple-cycle washing performance which may be used as a water-soluble builder in detergents or cleaning formulations and to the use of such alkali metal silicate compounds in detergents or cleaning formulations, to extruded detergents or cleaning formulations and to a process for their production.

Modem compacted detergents or cleaning formulations generally have the disadvantage that, on account of their compact structure, they show poorer solubility in aqueous liquors than, for example, lighter spray-dried detergents or cleaning formulations of the prior art. Detergents or cleaning formulations generally tend to show a poorer dissolving rate in water, the higher their degree of compaction. Zeolites which are typically present as builders in detergents or cleaning formulations can make an additional contribution to the impaired dissolving behavior on account of their insolubility in water.

A water-soluble alternative to zeolite are amorphous alkali metal silicates with multiple-cycle washing performance.

It is known that powder-form hydrated water-soluble silicates still containing around 20% by weight of water can be obtained by spray drying or roll drying of waterglass solutions (cf. Ullmanns Enzyclopädie der technischen Chemie, 4th Edition 1982, Vol. 21, page 412). Products such as these are commercially available for various purposes. Corresponding powders have a very loose structure as a result of spray drying, their apparent densities generally being well below 700 g/l.

Granular alkali metal silicates with higher apparent densities can be obtained in accordance with the teaching of European patent application EP-A-0 526 978. In the process disclosed in this document, an alkali metal silicate solution with a solids content of 30 to 53% by weight is introduced into a heated drum about the longitudinal axis of which rotates a shaft comprising a plurality of arms extending close to the inner surface of the drum, the drum wall having a temperature of 150 to 200° C. and the drying process being supported by a gas introduced into the drum with a temperature of 175 to about 250° C. This process gives a product with a mean particle size of 0.2 to 2 mm. A preferred drying gas is heated air.

European patent application EP-A-0 542 131 describes a process in which a product completely soluble in water at room temperature with an apparent density of 500 to 1200 g/l. Heated air is preferably used for drying. This process is also carried out using a cylindrical dryer with a heated wall (160 to 200° C.), about the longitudinal axis of which a rotor with vane-like blades rotates at such a speed that a pseudoplastic paste with a free water content of 5 to 12% by weight is formed from the silicate solution with a solids content of 40 to 60% by weight. The drying process is supported by a hot air stream (220 to 260° C.).

Earlier hitherto unpublished patent application P 44 19 745.4 also describes a water-soluble, amorphous and granular alkali metal silicate which is produced similarly to the method described in EP-A-0 526 978, but which contains silica. By "amorphous" is meant "X-ray amorphous". This means that, in X-ray diffractograms, the alkali metal silicates do not produce any sharp reflexes, but at best one or more broad maxima of which the width amounts to several degrees of the diffraction angle. However, this does not mean that zones producing sharp electron diffraction reflexes would not be found in electron diffraction experiments. This may be interpreted to mean that the substance has microcrystalline zones up to about 20 nm (max. 50 nm) in size.

Granular amorphous sodium silicates obtained by spray drying of aqueous waterglass solutions, subsequent grinding and subsequent compaction and spheronizing accompanied by additional drying of the ground material are the subject of U.S. Pat. Nos. 3,912,649, 3,956,467, 3,838,193 and 3,879,527. The products obtained have a water content of around 18 to 20% by weight for apparent densities well above 500 g/l.

Other granular alkali metal silicates with multiple-cycle washing performance are known from European patent applications EP-A-0 561 656 and EP-A-0 488 868. The products in question are compounds of alkali metal silicates with certain Q distributions and alkali metal carbonates. These compounds are produced by granulating powder-form water-free sodium carbonate in the presence of a sodium silicate solution (waterglass solution) and drying the products obtained in such a way that they have a certain residual water content bound to the silicate.

German patent application DE-A-44 06 592 describes absorbent alkali metal silicate compounds which are present in the form of a multicomponent mixture and which have been produced by spray drying of an aqueous preparation of the multicomponent mixture with superheated steam. Compounds such as these may be used as supports for liquid preparations of—in particular—surfactants.

European patent application EP-A-0 219 314 describes spray-dried high-surfactant granules containing (a) 30 to 60% by weight of a mixture of alkyl benzene sulfonate and $C_{12-16}$ alkyl sulfate in a ratio by weight of 4:1 to 1:4 and (b) alkali metal silicates in a ratio by weight of (a) to (b) of 1.5:1 to 6:1.

EP-A-0 651 050 describes a process for the production of agglomerates in which a salt, for example a silicate or carbonate, is processed with a water-containing "binder" which contains at least 20% by weight of silicate and at least 30% by weight of anionic surfactant.

European patent EP 486 592 describes a process for the production of high-density extrudates in which a solid free-flowing compound is extruded under pressure in strand form. The solid free-flowing compound contains a plasticizer and/or lubricant of which the effect is that the compound softens plastically under the pressure or the introduction of specific energy and thus becomes extrudable. After leaving the multiple-bore die, no further shear forces act on the system so that the viscosity of the system increases to such an extent that the extruded strand can be cut to predetermine extrudate dimensions. Now, it is known from International patent application WO-A-94/09111 that the compound to be extruded must contain both constituents which show pseudoplastic behavior and constituents which exhibit dilatant properties. If the compound were only to contain pseudoplastic constituents, it would soften to such an extent (even becoming almost liquid) under the effect of the pronounced shear gradient that the strand would no longer be cuttable after leaving the multiple-bore die. Accordingly, dilatant constituents are used which show increasing plasticity at increasing shear rates and which thus guarantee the cuttability of the extruded strand. Most ingredients of detergents or cleaning formulations show pseudoplastic behavior. Dilatant behavior is more the exception. However, there is one typical ingredient of conventional detergents or cleaning formulations which does show dilatant properties, namely the water-insoluble alumosilicates, such as zeolite, used as builders and phosphate substitutes. Although extruded detergents or cleaning formulations containing 19% by weight of zeolite (based on water-free active substance), 12.5% by weight of sodium carbonate and 2.2% by weight of amorphous sodium silicate are known from International patent application WO-A-94/09111, it was not known that zeolite could be partly or even completely replaced from the point of view of process technology by water-soluble inorganic builders, such as amorphous alkali metal silicates, providing they are used in a certain form. It has been found in this connection that some alkali metal silicate compounds with multiple-cycle washing performance lose some of that performance when processed under the effect of water, powerful shear forces and/or (slightly) elevated temperatures.

One of the problems addressed by the present invention was to provide water-soluble builders for the partial or complete replacement of zeolite in detergents or cleaning formulations so that the dissolving behavior, particularly of heavy detergents or cleaning formulations, would be improved. In addition, these water-soluble builders would also have the capacity to absorb ingredients of detergents or cleaning formulations that are liquid to wax-like at the processing temperature. The invention also set out to provide builders which would not lose their multiple-cycle washing performance, even during processing. Another problem addressed by the present invention was to provide extruded detergents or cleaning formulations which would contain the water-soluble builders to the extent that there would be little or no need for zeolite either from the performance point of view or from the point of view of process technology and a process for the production of these extruded detergents or cleaning formulations.

In a first embodiment, therefore, the present invention relates to a spray-dried amorphous alkali metal silicate compound with multiple-cycle washing performance and a molar ratio of $M_2O$ to $SiO_2$ (M=alkali metal) of 1:1.5 to 1:3.3 which contains anionic surfactants in quantities of 0.5 to less than 30% by weight.

Preferred amorphous alkali metal silicates have a molar $M_2O:SiO_2$ ratio (M=alkali metal) of 1:1.9 to 1:3 and, more particularly, up to 1:2.5. Sodium and/or potassium silicate are particularly suitable in this regard. The sodium silicates are preferred on economic grounds. However, if importance is attributed to a particularly high dissolving rate in water for performance reasons, it is advisable to replace sodium at least partly by potassium. For example, the composition of the alkali metal silicate may be selected so that the silicate has a potassium content, expressed as $K_2O$, of up to 5% by weight. Preferred alkali metal silicates are present in the form of a compound with alkali metal carbonate, preferably sodium and/or potassium carbonate. The water content of these preferred amorphous alkali metal silicate compounds is advantageously between 10 and 22% by weight and preferably between 12 and 20% by weight. Water contents of 14 to 19% by weight can be particularly advantageous.

The compounds according to the invention are obtained by spray drying of an aqueous slurry containing alkali metal silicates and anionic surfactants to form—in particular—alkali metal silicate compounds with water contents of 14 to 19% by weight. In one particular embodiment, the aqueous slurries to be spray dried additionally contain alkali metal carbonates, advantageously sodium carbonate and/or potassium carbonate.

Anionic surfactants suitable for use in the alkali metal silicate compounds are, above all, surfactants of the sulfonate and/or sulfate type. Preferred surfactants of the sulfonate type are $C_{9-13}$ alkyl benzene sulfonates, olefin sulfonates, i.e. mixtures of alkene and hydroxyalkane sulfonates, and the disulfonates obtained, for example, from $C_{12-18}$ monoolefins with a terminal or internal double bond by sulfonation with gaseous sulfur trioxide and subsequent alkaline or acidic hydrolysis of the sulfonation products. Other suitable surfactants of the sulfonate type are alkane sulfonates obtained from $C_{12-18}$ alkanes, for example by sulfochlorination or sulfoxidation and subsequent hydrolysis or neutralization. Suitable surfactants of the sulfate type are the sulfuric acid monoesters of primary alcohols of natural and synthetic origin. Preferred alk(en)yl sulfates are the alkali metal salts and, in particular, the sodium salts of the sulfuric acid semiesters of $C_{12-18}$ fatty alcohols, for example coconut oil fatty alcohol, tallow fatty alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{16-18}$ alk(en)yl sulfates are particularly preferred from the point of view of washing technology. It can also be of particular advantage, especially for machine detergents, to use $C_{16-18}$ alk(en)yl sulfates in combination with relatively low-melting anionic surfactants and, in particular, with anionic surfactants which have a lower Krafft point and which have a lower tendency to crystallize at relatively low washing temperatures, for example from room temperature to 40° C. In one preferred embodiment of the invention, therefore, the compounds contain mixtures of short-chain and long-chain fatty alkyl sulfates, preferably mixtures of $C_{12-14}$ fatty alkyl sulfates or $C_{12-18}$ fatty alkyl sulfates with $C_{16-18}$ fatty alkyl sulfates and, more particularly, $C_{12-16}$ fatty alkyl sulfates with $C_{16-18}$ fatty alkyl sulfates. However, another preferred embodiment of the invention is characterized by the use of unsaturated alkenyl sulfates with an alkenyl chain length of preferably $C_{16}$ to $C_{22}$ in addition to saturated alkyl sulfates. In this embodiment, mixtures of saturated sulfonated fatty alcohols consisting predominantly of $C_{16}$ and unsaturated, sulfonated fatty alcohols consisting predominantly of $C_{18}$, for example those derived from solid or liquid fatty alcohol mixtures of the HD-Ocenol® type (a product of Henkel KGaA), are particularly preferred. Ratios by weight of alkyl sulfates to alkenyl sulfates of 10:1 to 1:2 are preferred, ratios by weight of about 5:1 to 1:1 being particularly preferred.

2,3-Alkyl sulfates produced, for example, in accordance with U.S. Pat. Ser. No. 3,234,258 or 5,075,041 and commercially available under the name of DAN® from the Shell Oil Company are also suitable anionic surfactants.

The sulfuric acid monoesters of linear or branched $C_{7-21}$ alcohols ethoxylated with 1 to 6 moles of ethylene oxide, such as 2-methyl-branched $C_{6-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in detergents.

In one preferred embodiment of the invention, the compounds contain 15 to 80% by weight of alkali metal silicates, 1 to 25% by weight of anionic surfactants, preferably up to 20% by weight of anionic surfactants, and 10 to 22% by weight, preferably 12 to 19% by weight and more preferably 14 to 19% by weight of water. It has been found that quantities above 25% by weight of anionic surfactants, occasionally even above 20% by weight of anionic surfactants, in the compounds can again lead to a deterioration in the multiple-cycle washing performance of the detergent as a whole. Without wishing in any way to be confined to this theory, applicants assume that compounds containing relatively large amounts of anionic surfactants dissolve so quickly that negative interactions occur between the anionic surfactants and the hardness salts of the water before these salts can be eliminated by the silicate.

In another preferred embodiment of the invention, the compounds according to the invention contain 15 to 50% by weight and preferably 20 to 40% by weight of alkali metal silicates, 30 to 70% by weight and preferably 40 to 65% by weight of alkali metal carbonates, 1.5 to 15% by weight and preferably 2 to 12% by weight of anionic surfactants, advantageously alkyl benzene sulfonates and/or alk(en)yl sulfates, and 12 to 19% by weight of water.

The alkali metal silicate compounds may additionally contain other ingredients of detergents or cleaning formulations, preferably in quantities of up to 10% by weight and more preferably in quantities of not more than 5% by weight. These other ingredients include, for example, neutral salts, such as sodium or potassium sulfates, redeposition inhibitors and nonionic surfactants, such as alkyl polyglycosides.

The alkali metal silicate compounds according to the invention have a significant absorption capacity for ingredients of detergents or cleaning formulations that are liquid to wax-like at the usual processing temperatures. Although alkali metal silicate compounds are also capable of absorbing certain quantities of liquid components without the addition of anionic surfactants, it has been found that the addition of anionic surfactants increases the absorption capacity of the alkali metal silicate compounds and improves flow behavior. In one preferred embodiment of the invention, the alkali metal silicate compounds according to the invention containing anionic surfactants have an absorption capacity for liquid components which is at least 20% higher than that of the same quantity of alkali metal silicate compounds without anionic surfactants. Particularly preferred compounds have an absorption capacity for liquid components increased by at least 30% and, advantageously, by at least 50%, based on the absorption capacity of the same quantity of corresponding alkali metal silicate compounds without anionic surfactants.

In another embodiment, therefore, the present invention relates to spray-dried alkali metal silicate compounds which have been aftertreated with liquid components, including ingredients of detergents or cleaning formulations that are liquid to wax-like at the processing temperature. Suitable liquid components which can be absorbed by the alkali metal silicate compounds according to the invention are, for example, nonionic surfactants, cationic surfactants and/or foam inhibitors, such as silicone oils and paraffin oils. However, nonionic surfactants, for example alkoxylated, preferably ethoxylated and/or ethoxylated and propoxylated, aliphatic $C_{8-22}$ alcohols are particularly preferred. These include, in particular, primary alcohols preferably containing 8 to 18 carbon atoms and an average of 1 to 12 moles of ethylene oxide (EO) per mole of alcohol, in which the alcohol radical may be linear or, preferably, 2-methyl-branched or may contain linear and methyl-branched radicals in the form of the mixtures typically present in oxoalcohol radicals. However, alcohol ethoxylates containing linear radicals of alcohols of native origin with 12 to 18 carbon atoms, for example coconut oil fatty alcohol, palm oil fatty alcohol, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 5 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used. Examples of such fatty alcohols are tallow fatty alcohol containing 14 EO, 25 EO, 30 EO or 40 EO.

Another class of preferred nonionic surfactants which are used either as sole nonionic surfactant or in combination with the other nonionic surfactants mentioned are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533.

Compared with alkali metal silicate compounds free from anionic surfactants, even the primary spray-dried compounds according to the invention show stabilized multiple cycle washing performance during processing to detergents. In particular, however, those compounds according to the invention of which the surface was subsequently hydrophobicized, advantageously treated with nonionic surfactants, show stable multiple-cycle washing performance.

The alkali metal silicate compounds according to the invention are produced by spray drying. In one particularly preferred process, the alkali metal silicate compounds are produced by spray drying of an aqueous slurry containing all the constituents (except for the liquid components with which the compounds can be aftertreated) of the alkali metal silicate compounds.

In another embodiment of the invention, the compounds according to the invention are produced by spray drying of an aqueous preparation of the multicomponent mixture with superheated steam in accordance with the teaching of German patent application DE-A-44 06 592.

The alkali silicate compounds thus produced may be subsequently treated with ingredients of detergents or cleaning formulations. This may be done in the conventional manner, for example by mixing or by spraying on in a mixer/granulator, optionally followed by a heat treatment.

The amorphous alkali metal silicate compounds with multiple-cycle washing performance may be used as an additive for powder-form or granular detergents or cleaning formulations or as a constituent in the production of the granular detergents or cleaning formulations, preferably during the granulation and/or compaction phase. Depending on the method used for their production, the alkali metal silicate compounds can have apparent densities of 50 to—for example—850 g/l. By contrast, the detergents or cleaning formulations according to the invention may have an apparent density of 300 to 1200 g/l and preferably from 500 to 1000 g/l and contain the alkali metal silicate compounds according to the invention in quantities of preferably 5 to 50% by weight and, more preferably, 10 to 40% by weight. They may be produced by any of the known methods, such as mixing, spray drying, granulation, compaction, such as roll compaction, and extrusion. Processes in which several components, for example spray-dried components and granulated and/or extruded components, are mixed together are particularly suitable. Spray-dried or granulated components may also be subsequently treated during compounding with, for example, nonionic surfactants, more particularly ethoxylated fatty alcohols, by any of the usual methods. In granulation or extrusion processes in particular, the other anionic surfactants optionally present are preferably used in the form of a spray-dried, granulated or extruded compound either as a mixing component in the process or as an additive after other granules. It is also possible and may be of advantage, depending on the formulation, subsequently to add other individual constituents of the detergent, for example carbonates, citrate or citric acid or other polycarboxylates or polycarboxylic acids, polymeric polycarboxylates, zeolite and/or layer silicates, for example layer-form crystalline disilicates, to spray-dried, granulated and/or extruded components which are optionally treated with nonionic surfactants and/or other ingredients that are liquid to wax-like at the processing temperature. A preferred process in this regard is one in which the surface of components of the detergent or the detergent as a whole is subsequently treated to reduce the tackiness of the granules and/or to improve their solubility. Suitable surface modifiers are known from the prior art. Besides other suitable surface modifiers, fine-particle zeolites, silicas, amorphous silicates, fatty acids or fatty acid salts, for example calcium stearate, but above mixtures of zeolite and silica, more particularly in a ratio by weight of zeolite to silica of at least 1:1, or zeolite and calcium stearate are particularly preferred.

Particularly preferred embodiments of the invention are extruded detergents or cleaning formulations with an apparent density above 600 g/l which contain anionic and optionally nonionic surfactants and an amorphous alkali metal silicate compound of the described type in the extrudate. These extruded detergents or cleaning formulations can be produced by known extrusion processes, cf. in particular European patent EP-B-0 486 592. In this particular process, a solid free-flowing compound is extruded under pressures of up to 200 bar to form a strand, the strand is cut to a predetermined granule size by means of a cutting unit after leaving the extrusion die and the plastic and optionally still moist crude extrudate is subjected to another shaping or forming step and is subsequently dried, the alkali metal silicate compounds according to the invention being used in the compound.

In the production of extruded detergents or cleaning formulations in particular, the alkali metal silicate compounds containing anionic surfactants surprisingly have advantages over the alternative alkali metal silicate compounds free from anionic surfactants not only from the performance point of view but also from the point of view of process technology. It has been found that extrusion processes using alkali metal silicate carbonate compounds, more particularly compounds free from anionic surfactants, should not be interrupted because the extrusion mixture loses its plasticity and lubricity during the rest phase so quickly that restarting of the machine poses safety problems. This problem was solved by replacing the alkali metal silicate compounds free from anionic surfactants by corresponding compounds containing anionic surfactants, more particularly by alkali metal silicate compounds containing anionic surfactants and carbonate.

The final detergents or cleaning formulations may additionally contain the following ingredients.

These ingredients include in particular surfactants, above all anionic surfactants and optionally nonionic surfactants, but also cationic, amphoteric or zwitterionic surfactants.

Suitable anionic surfactants of the sulfonate type are the above-mentioned alkyl benzene sulfonates, olefin sulfonates and alkane sulfonates. However, the esters of α-sulfofatty acids (ester sulfonates), for example the α-sulfonated methyl esters of hydrogenated coconut oil, palm kernel oil or tallow fatty acids, are also suitable. Other suitable anionic surfactants are the α-sulfofatty acids obtainable by ester cleavage of the α-sulfofatty acid alkyl esters and disalts thereof. The monosalts of the α-sulfofatty acid alkyl esters are formed as an aqueous mixture with limited amounts of disalts during their production on an industrial scale. The disalt content of such surfactants is normally below 50% by weight of the anionic surfactant mixture, for example up to about 30% by weight.

Other suitable anionic surfactants are sulfonated fatty acid glycerol esters which are understood to be the mono-, di- and triesters and the mixtures thereof obtained where production is carried out by esterification of a monoglycerol with 1 to 3 moles of fatty acid or in the transesterification of triglycerides with 0.3 to 2 moles of glycerol.

Suitable surfactants of the sulfate type are the above-mentioned sulfuric acid monoesters of primary alcohols of natural and synthetic origin, 2,3-alkyl sulfates and optionally alkoxylated, preferably ethoxylated, derivatives of the sulfuric acid monoesters. Other preferred anionic surfactants are the salts of alkyl sulfosuccinic acid which are also known as sulfosuccinates or as sulfosuccinic acid esters and which represent the monoesters and/or diesters of sulfosuccinic acid with alcohols, preferably fatty alcohols and, more particularly, ethoxylated fatty alcohols. Preferred sulfosuccinates contain $C_{8-18}$ fatty alcohol radicals or mixtures thereof. Particularly preferred sulfosuccinates contain a fatty alcohol radical derived from fatty alcohols which, regarded in isolation, represent nonionic surfactants. Of these, sulfosuccinates of which the fatty alcohol radicals are derived from ethoxylated fatty alcohols with a narrow homolog distribution are particularly preferred. Alk(en)yl succinic acid preferably containing 8 to 18 carbon atoms in the alk(en)yl chain or salts thereof may also be used.

In addition to the anionic surfactants, the detergents may also contain soaps, preferably in quantities of 0.2 to 5%. Suitable soaps are saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow fatty acids.

The anionic surfactants and soaps may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

In one embodiment of the invention, the detergents or cleaning formulations, more particularly extruded detergents or cleaning formulations, contain 10 to 30% by weight of anionic surfactants. Of this quantity, preferably at least 3% by weight and more preferably at least 5% by weight advantageously consists of sulfate surfactants. In one advantageous embodiment, the detergents contain at least 15% by weight and, more particularly, 20 to 100% by weight of sulfate surfactants, based on the anionic surfactants as a whole.

Preferred nonionic surfactants are the alkoxylated, advantageously ethoxylated, alcohols preferably containing 8 to 18 carbon atoms and an average of 1 to 12 moles of ethylene oxide (EO) per mole of alcohol described earlier on.

The alkoxylated fatty acid alkyl esters similarly mentioned in the foregoing may also be used.

In addition, alkyl glycosides corresponding to the general formula $RO(G)_x$ may be used as further nonionic surfactants. In this general formula, R is a primary linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number of 1 to 10.

Nonionic surfactants of the amine oxide type, for example N-cocoalkyl-N,N-dimethyl amine oxide and N-tallow alkyl-N,N-dihydroxyethyl amine oxide, and the fatty acid alkanolamide type are also suitable. The quantity in which these nonionic surfactants are used is preferably no greater than and, in particular, no more than half the quantity in which the ethoxylated alcohols are used.

Other suitable surfactants are polyhydroxyfatty acid amides corresponding to formula (I):

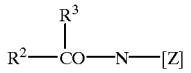

(I)

in which $R^2CO$ is an aliphatic acyl radical containing 6 to 22 carbon atoms, $R^3$ is hydrogen, an alkyl or hydroxyalkyl radical containing 1 to 4 carbon atoms and [Z] is a linear or branched polyhydroxyalkyl radical containing 3 to 10 carbon atoms and 3 to 10 hydroxyl groups. The polyhydroxyfatty acid amides are known substances which are normally obtained by reductive amination of a reducing sugar with ammonia, an alkylamine or an alkanolamine and subsequent acylation with a fatty acid, a fatty acid alkyl ester or a fatty acid chloride.

The detergents according to the invention contain nonionic surfactants in quantities of preferably 0.5 to 15% by weight and more preferably 2 to 10% by weight.

The detergents may also contain other additional builders and co-builders besides the amorphous alkali metal silicate compounds with multiple-cycle washing performance. For example, the detergents may contain typical builders, such as phosphates, zeolites and crystalline layer silicates. The synthetic zeolite used is preferably finely crystalline and contains bound water. Suitable zeolites are, for example, zeolite A, zeolite X and zeolite P and also mixtures of zeolites A, X and/or P. The zeolite may be used in the form of a spray-dried powder or even in undried form as a stabilized suspension still moist from its production. Where the zeolite is used in the form of a suspension, the suspension may contain small additions of nonionic surfactants as stabilizers, for example 1 to 3% by weight—based on zeolite—of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Zeolite suspensions and zeolite powders may also be used. Suitable zeolite powders have a mean particle size of smaller than 10 $\mu$m (volume distribution, as measured by the Coulter Counter method) and preferably contain 18 to 22% by weight and, more preferably, 20 to 22% by weight of bound water. Zeolite may be present in the detergents or cleaning formulations in quantities of up to about 40% by weight (based on water-free active substances).

In one particularly preferred embodiment of the invention, however, detergents or cleaning formulations contain 10 to 16% by weight of zeolite (based on water-free active substance) and 10 to 30% by weight of an alkali metal silicate compound according to the invention.

In another particularly preferred embodiment of the invention, however, the detergents or cleaning formulations contain 0 to 5% by weight of zeolite (based on water-free active substance) and 15 to 40% by weight of an alkali metal silicate compound according to the invention. In one possible variant of this embodiment, the zeolite is not only co-extruded, but also partly or completely introduced into the detergent or cleaning formulation in a subsequent step, i.e. after the extrusion step. Detergents or cleaning formulations containing an extrudate free from zeolite in its core are particularly preferred.

Crystalline layer silicates and/or conventional phosphates may also be used as substitutes for the zeolite. However, phosphates are only used in small quantities in the detergents or cleaning formulations, more particularly in quantities of up to at most 10% by weight.

Suitable crystalline layer silicates are, in particular, crystalline layer-form sodium silicates corresponding to the general formula $NaMSi_xO_{2x+1}yH_2O$, where M is sodium or hydrogen, x is a number of 1.9 to 4 and y is a number of 0 to 20, preferred values for x being 2, 3 or 4. Corresponding crystalline layer silicates are described, for example, in European patent application EP-A-0 164 514. Preferred crystalline layer silicates corresponding to the above formula are those in which M stands for sodium and x assumes a value of 2 or 3. Both β and δ sodium disilicates $Na_2Si_2O_5.yH_2O$ are particularly preferred. However, these crystalline layer silicates are preferably present in the extrudates according to the invention in quantities of no more than 10% by weight, more preferably in quantities of less than 8% by weight and advantageously in quantities of at most 5% by weight.

Polymeric polycarboxylates, for example, may be used as co-builders. Suitable polymeric polycarboxylates are, for example, the sodium salts of polyacrylic acid or polymethacrylic acid, for example those having a relative molecular weight of 800 to 150,000 (based on acid). Suitable copolymeric polycarboxylates are, in particular, those of acrylic acid with methacrylic acid and those of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000. Terpolymers are also particularly preferred, for example those which contain salts of acrylic acid and maleic acid and also vinyl alcohol or vinyl alcohol derivatives as monomers (DE-A-43 00 772) or those which contain salts of acrylic acid and 2-alkyl allyl sulfonic acid and sugar derivatives as monomers (DE-C-42 21 381). Other preferred copolymers are the copolymers which are described in German patent applications DE-A-43 03 320 and P 44 17 734.8 and which preferably contain acrolein and acrylic acid or acrylic acid salts or acrolein and vinyl acetate as monomers.

Other useful organic co-builders include, for example, the polycarboxylic acids preferably used in the form of their sodium salts, such as citric acid, adipic acid, succinic acid, glutaric acid, tartaric acid, sugar acids, aminocarboxylic acids, nitrilotriacetic acid (NTA), providing its use is not objectionable on ecological grounds, and mixtures thereof. Preferred salts are the salts of polycarboxylic acids, such as citric acid, adipic acid, succinic acid, glutaric acid, tartaric acid, sugar acids and mixtures thereof.

Other suitable builder systems are the oxidation products of carboxy-functional polyglucosans and/or water-soluble salts thereof which are described, for example, in International patent application WO-A-93/08251 or of which the production is described, for example, in International patent application WO-A-93/16110.

Other preferred builders are the known polyaspartic acids and salts and derivatives thereof.

Polyacetals obtained by reaction of dialdehydes with polyol carboxylic acids containing 5 to 7 carbon atoms and at least three hydroxyl groups, for example as described in European patent application EP-A-0 280 223, are also suitable builders. Preferred polyacetals are obtained from dialdehydes, such as glyoxal, glutaraldehyde, terephthalaldehyde and mixtures thereof, and from polyol carboxylic adds, such as gluconic acid and/or glucoheptonic acid.

These co-builders may be present in the final detergents or cleaning formulations in quantities of, for example, 0.5 to 20% by weight and preferably in quantities of 2 to 15% by weight.

In addition, the detergents may also contain components with a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derivatives thereof.

The detergents or cleaning formulations may additionally contain components which further improve the solubility of the heavy granules in particular. Corresponding components and their incorporation are described, for example, in International patent application WO-A-93/02176 and in German patent application DE-A-42 03 031. Preferred components of the type in question include in particular fatty alcohols containing 20 to 80 moles of ethylene oxide per mole of fatty alcohol, for example tallow fatty alcohol containing 30 EO and tallow fatty alcohol containing 40 EO, fatty alcohols containing 14 EO and polyethylene glycols with a relative molecular weight of 200 to 2,000.

Among the compounds yielding $H_2O_2$ in water which serve as bleaching agents, sodium perborate monohydrate is of particular importance. Other useful bleaching agents are, for example, sodium perborate tetrahydrate, sodium percarbonate, peroxypyrophosphates, citrate perhydrates and $H_2O_2$-yielding peracidic salts or peracids, such as perbenzoates, peroxophthalates, diperazelaic acid or diperdodecanedioic acid. The content of bleaching agents in the detergents or cleaning formulations is preferably 5 to 25% by weight and, more particularly, 10 to 20% by weight, perborate monohydrate advantageously being used. Percarbonate is also a preferred constituent. However, percarbonate is preferably not co-extruded but is optionally added in a subsequent step.

In order to obtain an improved bleaching effect where washing is carried out at temperatures of 60° C. or lower, bleach activators may be incorporated in the formulations. Examples of bleach activators are N-acyl or O-acyl compounds which form organic peracids with $H_2O_2$, preferably N,N'-tetraacylated diamines, p-(alkanoyloxy)-benzene sulfonates, carboxylic anhydrides and esters of polyols, such as glucose pentaacetate. Other known bleach activators are acetylated mixtures of sorbitol and mannitol of the type described, for example, in European patent application EP-A-0 525 239. The content of bleach activators in the bleach-containing detergents is in the usual range, preferably from 1 to 10% by weight and more preferably from 3 to 8% by weight, again based on the final detergent. Particularly preferred bleach activators are N,N,N'N'-tetraacetyl ethylenediamine (TAED), 1,5-diacetyl-2,4-dioxohexahydro-1,3,5-triazine (DADHT) and acetylated sorbitol/mannitol mixtures (SORMAN).

It can be of advantage to add typical foam inhibitors to the detergents or cleaning formulations. Suitable foam inhibitors are, for example, soaps of natural or synthetic origin with a high percentage content of $C_{18-24}$ fatty acids. Suitable non-surface-active foam inhibitors are, for example, organopolysiloxanes and mixtures thereof with microfine, optionally silanized silica and also paraffins, waxes, microcrystalline waxes and mixtures thereof with silanized silica or bis-stearyl ethylenediamide. Mixtures of various foam inhibitors, for example mixtures of silicones, paraffins or waxes, are also used with advantage. The foam inhibitors, above all silicone- and/or paraffin-containing foam inhibitors, are advantageously fixed to a granular water-soluble or water-dispersible support. Mixtures of paraffins and bis-stearyl ethylenediamides are particularly preferred.

Suitable enzymes are those from the class of proteases, lipases, amylases, cellulases or mixtures thereof. Enyzmes obtained from bacterial strains or fungi, such as *Bacillus subtilis, Bacillus licheniformis, Streptomyces griseus* and *Humicola insolens,* are particularly suitable. Proteases of the subtilisin type are preferred, proteases obtained from *Bacillus lentus* being particularly preferred. Enzyme mixtures, for example of protease and amylase or protease and lipase or protease and cellulase or of cellulase and lipase or of protease, amylase and lipase or of protease, lipase and cellulase, but especially protease- and/or lipase-containing mixtures are of particular interest. Peroxidases or oxidases have also proved to suitable in some cases. The enzymes may be adsorbed to supports and/or encapsulated in shell-forming substances to protect them against premature decomposition. The percentage content of the enzymes, enzyme mixtures or enzyme granules in the final detergent may be, for example, from about 0.1 to 5% by weight and is preferably from 0.1 to about 2% by weight.

Suitable stabilizers, particularly for per compounds and enzymes, are the salts of polyphosphonic acids, more particularly 1-hydroxyethane-1,1-diphosphonic acid (HEDP), diethylenetriamine pentamethylenephosphonic acid (DETPMP) or ethylenediamine tetramethylenephosphonic acid.

The detergents or cleaning formulations may also contain other enzyme stabilizers. For example, they may contain from 0.5 to 1% by weight of sodium formate. Proteases which are stabilized with calcium salts and which have a calcium content of preferably about 1.2% by weight, based on the enzyme, may also be used. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

The function of redeposition inhibitors is to keep the soil detached from the fibers suspended in the wash liquor and thus to prevent discoloration. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (Na salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone may also be used, for example in quantities of 0.1 to 5% by weight, based on the detergent.

The detergents may contain derivatives of diaminostilbene disulfonic acid or alkali metal salts thereof as optical brighteners. Suitable optical brighteners are, for example, salts, of 4,4'-bis-(2-anilino-4-morpholino-1,3,5-triazinyl-6-amino)-stilbene-2,2'-disulfonic acid or compounds of similar composition which contain a diethanolamino group, a methylamino group, an anilino group or a 2-methoxyethylamino group instead of the morpholino group. Brighteners of the substituted diphenyl styryl type, for example alkali metal salts of 4,4'-bis2-sulfostyryl)-diphenyl, 4,4'-bis-(4-chloro-3-sulfostyryl)-diphenyl or 4-(4-chlorostyryl)-4'-sulfostyryl)-diphenyl, may also be present. Mixtures of the brighteners mentioned above may also be used.

In addition to the alkali metal silicate compounds which, in a preferred embodiment, also contain alkali metal carbonates, the detergents or cleaning formulations may contain other inorganic salts and other amorphous alkali metal silicates of the type described above and alkali metal carbonates of the type described above. Other inorganic salts suitable as ingredients are neutral salts, such as sulfates and optionally even chlorides in the form of their sodium and/or potassium salts.

The detergents or cleaning formulations may of course also contain the dyes and fragrances typically present in detergents or cleaning formulations.

EXAMPLES

Example 1—Production of Alkali Metal Silicate Compounds

Alkali metal silicate compounds C1 to C4 according to the invention and comparison compound CC were obtained by conventional spray drying of an aqueous slurry. The composition of the compounds (in % by weight) was as follows:

| | C1 | C2 | C3 | C4 | CC |
|---|---|---|---|---|---|
| Amorphous sodium disilicate | 28.1 | 28.1 | 27.3 | 24.65 | 29.0 |
| Sodium carbonate | 53.4 | 53.4 | 51.7 | 46.75 | 55.0 |
| $C_{12-18}$ Alkyl sulfate (sodium salt) | 3.0 | — | — | — | — |
| $C_{12}$ Alkyl benzene sulfonate (sodium salt) | — | 3.0 | 6.0 | 15.0 | — |
| Water | 15.5 | 15.5 | 15.0 | 13.6 | 16.0 |

Example 2—Absorption Capacity of the Alkali Metal Silicate Compounds (Flow Test)

The absorption capacity of alkali metal silicate compounds C1 to C4 according to the invention was tested against comparison compound CC used in the same quantity using a nonionic surfactant of which 80% by weight consisted of $C_{12-18}$ fatty alcohol·5 EO and 20% by weight of $C_{12-14}$ fatty alcohol·3 EO. The nonionic surfactant absorption capacity was determined in accordance with DIN ISO 787, except that the nonionic surfactant mentioned above was used instead of the specified linseed oil. For this determination, a weighed quantity of sample is placed on a plate. 4 or 5 drops of nonionic surfactant are then slowly added all at once from a burette. After each addition, the nonionic surfactant is rubbed into the powder with a spatula. Addition of the nonionic surfactant is continued accordingly until agglomerations of nonionic surfactant and powder have formed. From this point onwards, one drop at a time of nonionic surfactant is added and rubbed in with the spatula. Addition of the nonionic surfactant is terminated when a soft paste has formed.

This paste should lend itself to spreading without breaking up or crumbling and should still just adhere to the plate. The quantity of nonionic surfactant added is read off from the burette and converted into ml of nonionic surfactant per 100 g of sample. The following results were obtained:

| | ml of Nonionic Surfactant per 100 g of Carrier |
|---|---|
| C1 | 97 |
| C2 | 110 |
| C3 | 128 |
| C4 | 130 |
| CC | 57 |

Example 3—Extrudability

The following extrudates E1 to E4 according to the invention and comparison extrudate CE were produced in accordance with the teaching of International patent application WO-A-94/02047. The extrusion mixtures of detergents E1 to E4 could be extruded without any process-related problems. Comparison product CE could only be produced as long as the production process was not interrupted for more than 60 minutes. The compositions of the extrudates are as shown in Table 1. The apparent density of the extrudates was between 750 and 780 g/l. Both the extrudates according to the invention and the comparison extrudate showed good dissolving behavior. Only slight residues were obtained in the dispensing test and in the solubility test.

| | E1 | E2 | E3 | E4 | CE |
|---|---|---|---|---|---|
| $C_{9-13}$ Alkyl benzene sulfonate | 11.5 | 11.5 | 11.5 | 11.5 | 11.5 |
| $C_{12-18}$ Alkyl sulfate | 10.5 | 10.5 | 10.5 | 10.5 | 10.5 |
| $C_{12-18}$ Alcohol · 7 EO | 4.0 | 4.0 | 4.0 | 4.0 | 4.0 |
| $C_{12-18}$ Fatty acid soap | 1.0 | 1.0 | 1.0 | 1.0 | 1.0 |
| Polyethylene glycol, relative molecular weight 400 | 1.5 | 1.5 | 1.5 | 1.5 | 1.5 |
| Zeolite (water-free active substance) | 19.0 | 19.0 | 19.0 | 19.0 | 19.0 |
| Acrylic acid/maleic acid copolymer (sodium salt) | 6.0 | 6.0 | 6.0 | 6.0 | 6.0 |
| Alkali metal silicate compound C1 | 14.0 | — | — | — | — |
| Alkali metal silicate compound C2 | — | 14.0 | — | — | — |
| Alkali metal silicate compound C3 | — | — | 14.0 | — | — |

-continued

| | E1 | E2 | E3 | E4 | CE |
|---|---|---|---|---|---|
| Alkali metal silicate compound C4 | — | — | — | 14.0 | — |
| Alkali metal silicate compound CC | — | — | — | — | 14.0 |
| Perborate monohydrate | 21.0 | 21.0 | 21.0 | 21.0 | 21.0 |
| Phosphonate | 0.7 | 0.7 | 0.7 | 0.7 | 0.7 |
| Sodium sulfate | 1.5 | 1.5 | 1.5 | 1.5 | 1.5 |
| Water and salts from solutions | Balance | Balance | Balance | Balance | Balance |

What is claimed is:

1. A spray-dried amorphous alkali metal silicate compound providing multiple-cycle washing performance and having a molar ratio of $M_2O$ to $SiO_2$ of 1:1.5 to 1:3.3, wherein M represents an alkali metal, the compound consisting essentially of 15 to 80% by weight of alkali metal silicate, an alkali metal carbonate, 0.5 to less than 20% by weight of an anionic surfactant comprising a $C_{9-13}$ alkyl benzene sulfonate, and water, all weights being based on the weight of the alkali metal silicate compound, the compound having an absorption capacity for liquid components which is at least 20% higher than that of the same quantity of the alkali metal silicate which is free from anionic surfactant, and wherein the compound is aftertreated with liquid components that are ingredients of detergents or cleaning composition.

2. An alkali metal silicate compound as recited in claim 1 and consisting essentially of 15 to 80% by weight of the alkali metal silicate, 30 to 70% by weight of the alkali metal carbonate, 1 to less than 20% by weight of the anionic surfactant, and 10 to 22% by weight of water, all weights being based on the weight of the alkali metal silicate compound.

3. A detergent of cleaning composition containing 0 to 5% by weight of zeolite, nased on water-free active substance, and 15 to 40% by weight of an alkali metal silicate compound as recited in claim 1.

4. A process for the production of an amorphous alkali metal silicate compound providing multiple-cycle washing performance, comprising the step of:

spray-drying an aqueous slurry consisting essentially of 15 to 80% by weight of an alkali metal silicate having a molar ratio of $M_2O$ to $SiO_2$ of 1:1.5 to 1:3.3; wherein M represents an alkali metal, 30 to 70% by weight of an alkali metal carbonate, 1 to less than 20% by weight of an anionic surfactant comprising a $C_{9-13}$ alkyl benzene sulfonate, and 10 to 22% by weight by weight of water, all weights being based on the weight of the alkali metal silicate compound.

5. A process as recited in claim 4, wherein the spray-dried alkali metal silicate compound is subsequently treated with liquid ingredients of detergents or cleaning formulations.

6. An extruded detergent or cleaning composition having an apparent density above 600 g/l consisting essentially of anionic and optionally nonionic surfactants and an amorphous alkali metal silicate, the amorphous alkali metal silicate consisting essentially of a spray-dried amorphous metal silicate compound providing multiple-cycle washing performance and having a molar ratio of $M_2O$ to $SiO_2$ of 1:1.5 to 1:3.3, wherein M represents an alkali metal, the compound consisting essentially of 15 to 80% by weight of alkali metal silicate, an alkali metal carbonate, 0.5 to less than 20% by weight of an anionic surfactant comprising a $C_{9-13}$ alkyl benzene sulfonate, and water, all weights being based on the weight of the alkali metal silicate compound, wherein the compound has an absorption capacity for liquid components which is at least 20% higher than that of the same quantity of the alkali metal silicate compound which is free from anionic surfactant.

7. A process for the production of a detergent or cleaning composition comprising the steps of:

extruding the compound recited in claim 1 under a pressure of up to 200 bar to form a strand;

cutting the strand to a predetermined granule size;

subjecting the strand to a forming step; and subsequently drying the cut and formed strand.

* * * * *

UNITED STATES PATENT AND TRADEMARK OFFICE

CERTIFICATE OF CORRECTION

PATENT NO. : 6,458,755 B2 
DATED : October 1, 2002
INVENTOR(S) : Schnepp-Hentrich et al.

It is certified that error appears in the above-identified patent and that said Letters Patent is hereby corrected as shown below:

Column 15,
Line 26, after “silicate”, insert -- compound --.
Line 37, delete “nased”, and insert therefor -- based --.

Signed and Sealed this

Sixteenth Day of September, 2003

JAMES E. ROGAN
*Director of the United States Patent and Trademark Office*